US007025635B2

(12) United States Patent
Chang

(10) Patent No.: US 7,025,635 B2
(45) Date of Patent: Apr. 11, 2006

(54) STRUCTURE OF CONNECTOR FOR REDUCING ELECTRO-MAGNETIC WAVE INTERFERENCE

(75) Inventor: Chih-Kai Chang, Taoyuan Hsien (TW)

(73) Assignee: Speed Tech Corp., (TW)

( * ) Notice: Subject to any disclaimer, the term of this patent is extended or adjusted under 35 U.S.C. 154(b) by 0 days.

(21) Appl. No.: 10/876,455

(22) Filed: Jun. 28, 2004

(65) Prior Publication Data

US 2005/0026509 A1 Feb. 3, 2005

(30) Foreign Application Priority Data

Jul. 30, 2003 (TW) ..... 92213862 U

(51) Int. Cl.
*H01R 13/66* (2006.01)

(52) U.S. Cl. ..... 439/620; 439/676; 439/941

(58) Field of Classification Search ..... 439/620, 439/676, 344, 941, 79, 540.1, 541.5
See application file for complete search history.

(56) References Cited

U.S. PATENT DOCUMENTS 6,641,440 B1 * 11/2003 Walker et al. ..... 439/620
6,702,610 B1 * 3/2004 Zheng et al. ..... 439/676
6,773,302 B1 * 8/2004 Gutierrez et al. ..... 439/541.5
6,896,542 B1 * 5/2005 Chang ..... 439/620

* cited by examiner

*Primary Examiner*—Tho D. Ta
*Assistant Examiner*—Felix O. Figueroa
(74) *Attorney, Agent, or Firm*—Bacon & Thomas, PLLC

(57) ABSTRACT

A connector for reducing electro-manetic wave interference has a receiving module, a first circuit board, a second circuit board, a third circuit board and adaptor module. The circuits of various characteristics are set onto the first circuit board and the second circuit board respectively for reducing electro-magnetic wave interferences during signal transmission.

10 Claims, 4 Drawing Sheets

STRUCTURE OF CONNECTOR FOR REDUCING ELECTRO-MAGNETIC WAVE INTERFERENCE

BACKGROUND OF THE INVENTION

1. The Field of the Invention

The present invention relates to a structure of a connector, and more particularly to a structure of a connector comprising circuits having various electrical characteristics placed on different circuit boards for reducing electro-magnetic wave interference generated during the signal transmission.

2. Description of Related Art

The rapid advancement of computer technology has led to wide use of desktop computers or notebook computers. The user can use the computer to link up to the Internet to retrieve/transmit data. Therefore network technology provides convenience for accessing/transmitting information, which has become indispensable. Accordingly, the computer needs a connector for connecting to the Internet adaptor, and generally such connector is a RJ45. An RJ45 connector is generally used in connecting a computer to a Local Area Network (LAN) or connecting an Integrated Services Digital Network (ISDN) to a network terminal. However, an RJ45 connector easily generates high frequency electro-magnetic wave that interferes with other electronic appliances. On the other hand, the signal from the RJ45 also can be interfered by the external transmission wire. Some manufacturers propose to use a metallic case to cover the connector and, a capacitor and a wave filter installed inward for reducing the electro-magnetic wave interference and protecting from sudden abnormal voltage surge. So a technique of reducing electro-magnetic wave interference is to arrange the electronic elements and the input/output circuit on a circuit board for adding value to such connector. FIG. 4 illustrates an exploded view of a conventional connector. As shown in FIG. 4, the connector comprises a terminal set comprising an inserting set B and an adapter D inlayed in the isolation case A. The inserting set B and the adapter D comprise a plurality of terminals B1 and D1 welded to the circuit board C. The isolation case A comprises two arms A1 extending from a backside thereof for buckling to the indentations C1 formed on two sides of the circuit board C. The isolation case A can be surrounded by a metallic case E in order to reduce the electro-magnetic wave. The plurality of terminals D1 of the adapter D can be electrically connected to the circuit board positioned at a lower side to complete the assembly of the conventional connector. For minimizing the space occupation of the circuit board in a computer, having a circuit board deployed within the connector, and an input/output signal wire disposed on said circuit board despite the signal itself gets interfered easily by the other terminals D1 nearby. The defects of the above described connector as are follows.

The circuits of various electrical characteristics are disposed over said circuit board in the connector and therefore electro-magnetic wave interference occurs for the high-density circuit.

The connector has a circuit board in itself and the space for the circuits and electronic elements is insufficient. Accordingly, a motherboard is necessary, and this approach results in another problem of limiting space on motherboard as the electronic elements of the connector occupies significant space on the motherboard.

Therefore, to solve the above defects is an important issue to the manufacturer in the field.

SUMMARY OF THE INVENTION

Accordingly, in the view of the foregoing, the present inventor makes a detailed study of related art to evaluate and consider, and uses years of accumulated experience in this field, and through several experiments, to create a new structure of a connector. The present invention provides an innovated cost effective structure of a connector capable of reducing electro-magnetic wave interference generated during signal transmission.

According to an aspect of the present invention, circuits of various electrical characteristics are placed on different circuit boards for effectively reducing the electro-magnetic wave interference during signal transmission.

BRIEF DESCRIPTION OF THE DRAWING

For a more complete understanding of the present invention, reference will now be made to the following detailed description of preferred embodiments taken in conjunction with the following accompanying drawings.

DETAILED DESCRIPTION OF PREFERRED EMBODIMENTS

Figure 1:
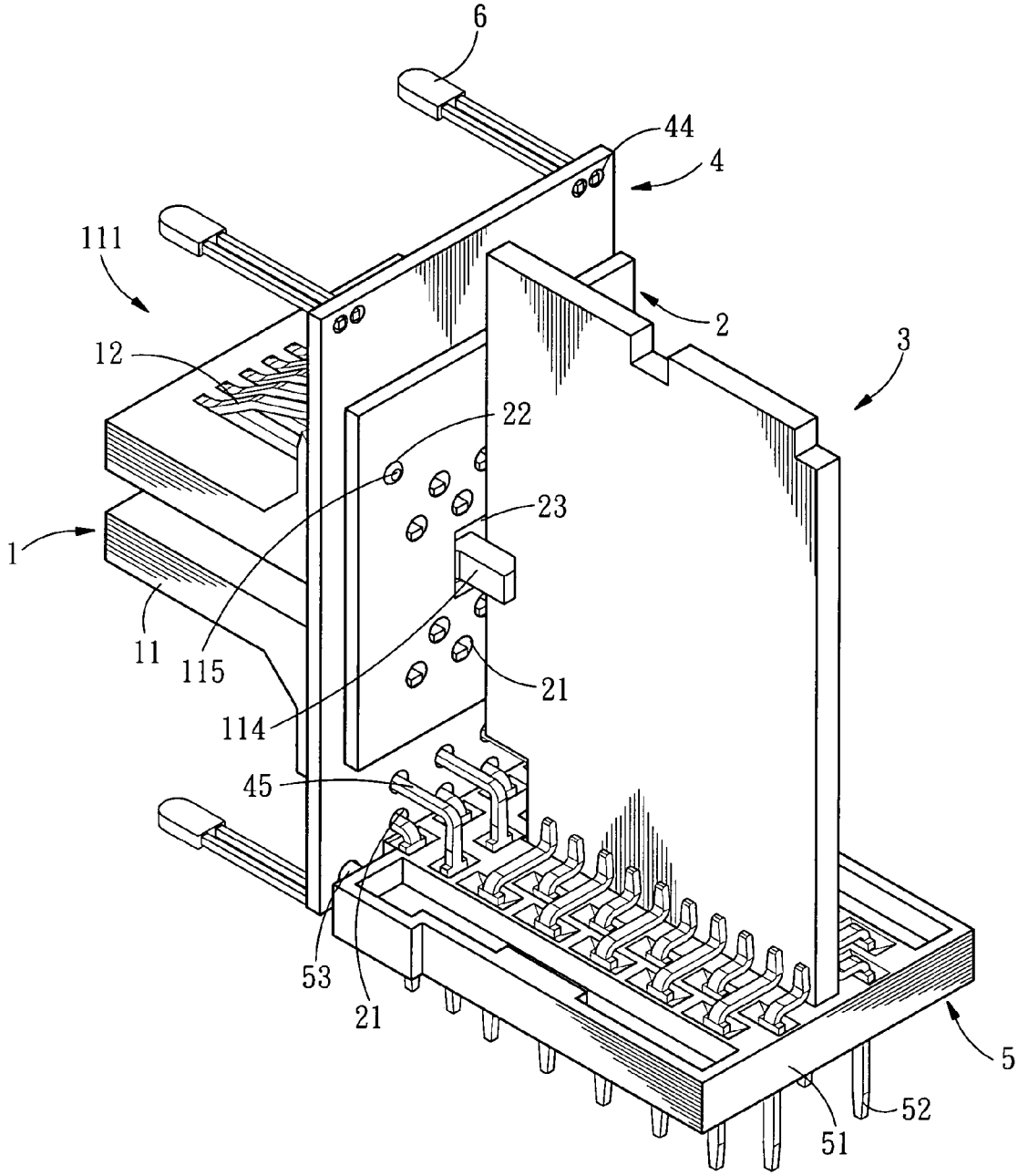
FIG. 1 is an elevational view of a structure of a connector according to an embodiment of the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
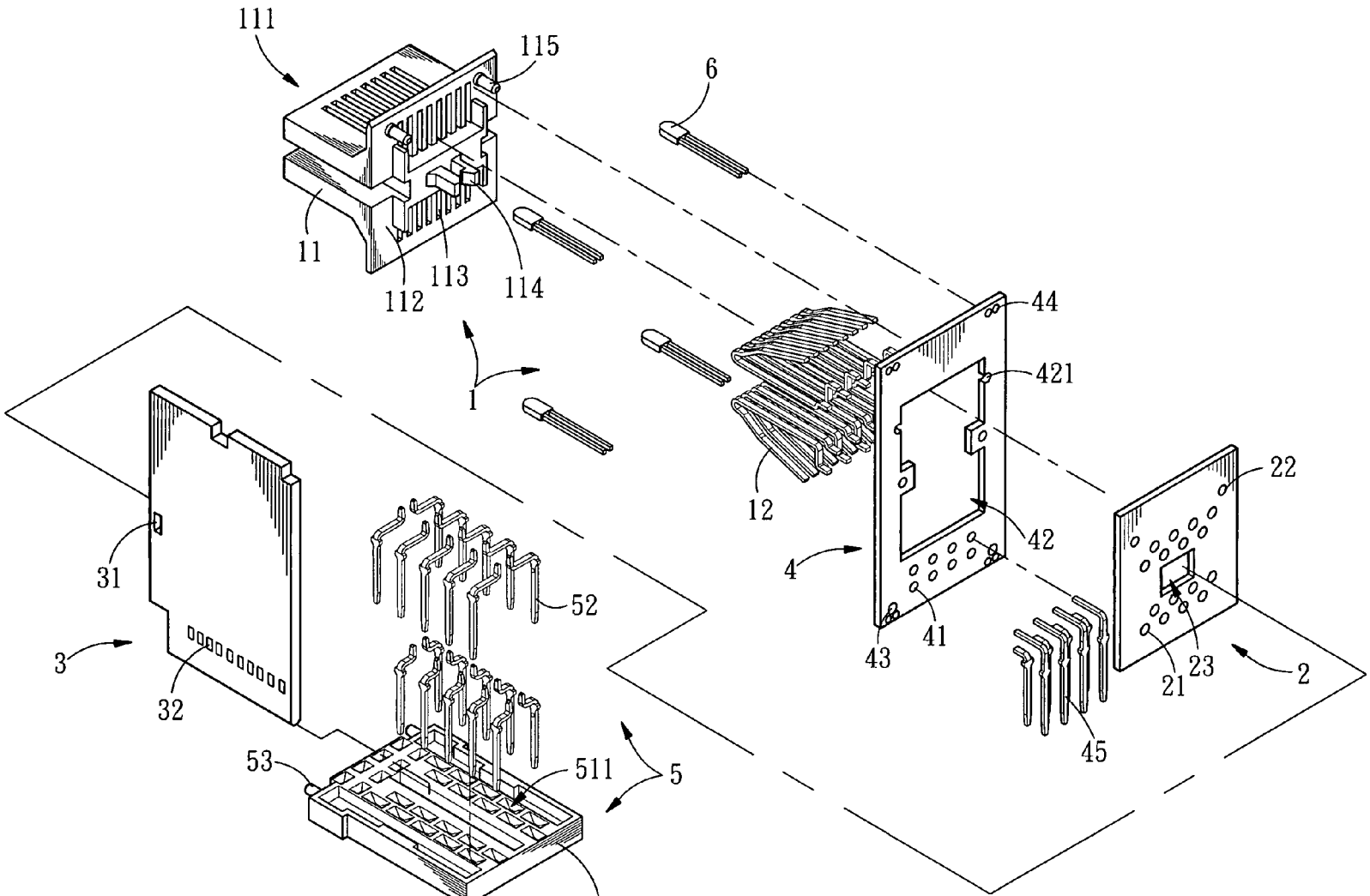
FIG. 2 is an exploded view of a structure of the connector shown in FIG. 1.
Figure 3:
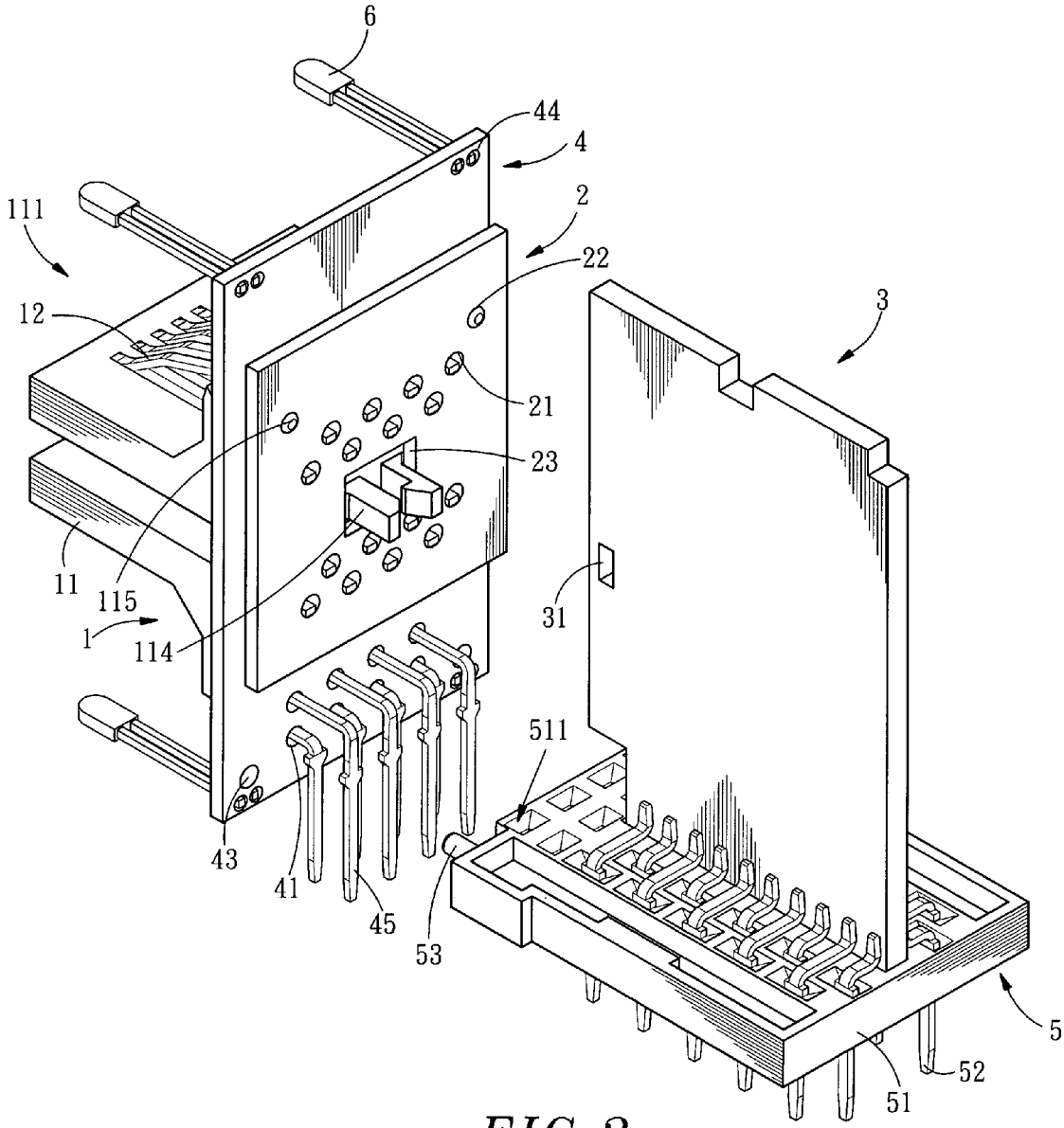
FIG. 3 is an exploded view after partial assembly of the elements of the connector shown in FIG. 1.
Figure 4:
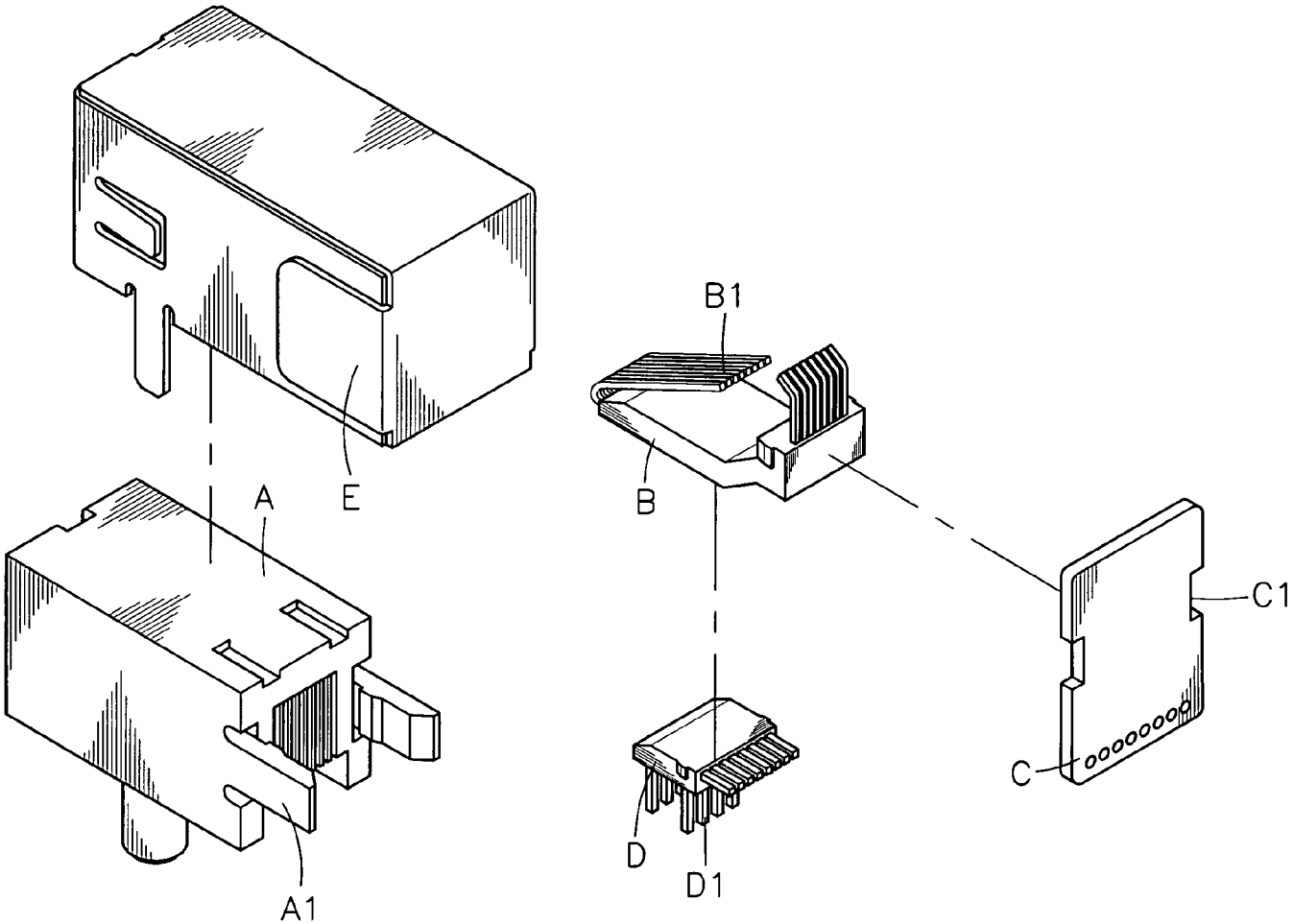
PRIOR ART FIG. 4
FIG. 4 is an exploded view of a conventional connector.

Referring to FIGS. 1, 2 and 3, the connector according to an embodiment of the present invention comprises an inserting module 1, a first circuit board 2, a second circuit board 3, a third circuit board 4, an adaptor module 5 and light-emitting diodes 6.

The inserting module 1 comprises a terminal set 11 and a plurality of terminals 12. The terminal set 11 comprises an inserting portion 111 formed at a side hereof and a receiving portion 112 formed at another side opposed to the inserting portion 111 thereof. The receiving portion 112 comprises a plurality of through slits 113, which are through the terminal set 11, connecting to the inserting portion 111 and two corresponding outwardly protruding hook-shaped clamping portions 114 and the positioning element 115.

The first circuit board 2 comprises a plurality of connecting points 21, positioning holes 22 formed on a surface thereof, and the output circuit. Further, the first circuit board 2 comprises a through hole 23.

The second circuit board 3 comprises a plurality of connecting points 32, a buckling hole 31 and an input circuit, and is positioned perpendicular to the first circuit board 2.

The third circuit board 4 comprises a plurality of connecting points 41 having welded conducting terminals 45. The third circuit board 4 further comprises a suspended portion 42, positioning holes 43 and welding points 44 formed on a surface thereof. The suspended portion 42 comprises indentations 421 formed on two sides thereof. The third circuit board 4 comprises a circuit having light-emitting diodes 6.

The adaptor module 5 comprises an adaptor terminal set 51 and adaptor terminals 52. The adaptor terminal set 51 comprises a plurality of through holes 511 and positioning elements 53 extending from a side thereof.

Hereinafter, the assembly of the connector according to an embodiment of the present invention is described as follows. The plurality of terminals 12 are inserted into the through holes 113 of the terminal set 11. The positioning elements 115 of the terminal set 11 are fitted into the indentations 421 of the third circuit board 4 to position the third circuit board 4 to the receiving portion 112. The first circuit board 2 is held tightly against the third circuit board 4 for the hook-shaped clamping portions 114 clamps the first circuit board 2 through the suspended portion 42 of the third circuit board 4 and the plurality of terminals 12 are welded to electrically connect to the connecting points 21 of the first circuit board 2. The clamping portions 114 of the receiving portion 112 are fitted in an orderly manner through the suspended portion 42 of the third circuit board 4 and the through hole 23 of the first circuit board 2, wherein an end portions of the clamping portions 114 extend out of the through hole 23. Furthermore, the plurality of adaptor terminals 52 are welded onto the plurality of connecting points 32 of the second circuit board 3, and the plurality of adaptor terminals 52 and the conducting terminals 45 are inserted into through holes 511 of the adaptor terminal set 51 of the adaptor module 5 for positioning. The edge of the buckling hole 31 of the second circuit board 3 is pushed towards the corresponding hook-shaped clamping portions 114 of the receiving portion 112 to buckle the clamping portions 114 into the buckling hole 31. Meanwhile, the positioning elements 53 of the adaptor terminal set 51 are pressed into the positioning holes 43 on the surface of the third circuit board 4 for positioning and thereby complete the assembly of the inner module for receiving the RJ45 connector.

There are four light-emitting diodes 6 welded on the welding points 44 on the corners of the third circuit board 4 in this embodiment of this invention.

Additionally, according to an embodiment of the present invention, the circuits of different electrical characteristics are arranged on the first, second and third circuit boards 2, 3 and 4 respectively for reducing electro-magnetic wave interference during the signal transmission, such as the first circuit board 2 comprises an output circuit, the second circuit board 3 comprises an input circuit and the third circuit board 4 comprises a circuit having the light-emitting diodes 6. Because the first and second circuit boards 2 and 3 have the output and input circuits respectively, therefore the third circuit board 4 is further expandable without affecting the performance of the connector of the present invention.

According to an aspect of the present invention, the output and the input circuits are formed on the first and second circuit boards 2 and 3 respectively to reduce electro-magnetic wave interference during the signal transmission.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

The invention claimed is:

1. A structure of a connector, comprising:

a receiving module, comprising a terminal set having an inserting portion at a side thereof and a receiving portion formed at another side thereof, wherein said terminal set comprises a plurality of terminals;

a first circuit board, comprising a plurality of connecting points and an output circuit, positioned tightly against said receiving portion of said terminal set;

a second circuit board, comprising a plurality of connecting points and an input circuit, positioned perpendicular to said first circuit board; and an adaptor module, comprising an adaptor terminal set having through holes for positioning a plurality of adaptor terminals and said adaptor terminals electrically connecting to said connecting points of said first circuit board, wherein circuits having various electrical characteristics are set onto said first circuit board and said second circuit board respectively for reducing inferences during signal transmission;

wherein said receiving portion of said receiving module comprises two corresponding hook-shaped clamping portions, and said first circuit board comprises a through hole, said second circuit board comprises a buckling hole near a surface of said first circuit board, and wherein said clamping portions can fit through said through hole of said first circuit to buckle to said buckling hole for positioning.

2. The structure of a connector according to claim 1, wherein the connector further has a third circuit board which is positioned between said receiving portion of said terminal set and said first circuit board, wherein said third circuit board comprises a plurality of connecting points, suspended portion, a plurality of welding points and a plurality of positioning holes, wherein conducting terminals are welded to said connecting points and said welding points are adapted for welding light-emitting diodes.

3. The structure of a connector according to claim 2, wherein said adaptor terminal set comprises a plurality of positioning elements extending from a side thereof for inserting into corresponding positioning holes of said third circuit board for positioning.

4. The structure of a connector according to claim 1, wherein said terminal set comprises through holes for fitting said plurality of terminals.

5. The structure of a connector according to claim 2, wherein said receiving portion of said terminal set comprises a plurality of positioning elements extending from a side thereof for inserting into corresponding indentations of said third circuit board for positioning.

6. A structure of a connector, comprising:

a receiving module, comprising a terminal set having an inserting portion at a side thereof and a receiving portion formed at another side thereof, wherein said terminal set comprises a plurality of terminals;

a first circuit board, comprising a plurality of connecting points and an output circuit, positioned tightly against said receiving portion of said terminal set;

a second circuit board, comprising a plurality of connecting points and an input circuit, positioned perpendicular to said first circuit board;

a third circuit board positioned between said receiving portion of said terminal set and said first circuit board, the third circuit board comprising a plurality of connecting points, a suspended portion, a plurality of welding points and a plurality of positioning holes, wherein conducting terminals are welded to said connecting points and said welding points are adapted for welding light-emitting diodes; and an adaptor module, comprising an adaptor terminal set having through holes for positioning a plurality of adaptor terminals and said adaptor terminals electrically connecting to said connecting points of said first circuit board, wherein circuits having various electrical characteristics are set onto said first circuit board and said second circuit board respectively for reducing inferences during signal transmission.

7. The structure of a connector according to claim 6, wherein said adaptor terminal set comprises a plurality of positioning elements extending from a side thereof for inserting into corresponding positioning holes of said third circuit board for positioning.

8. The structure of a connector according to claim 6, wherein said terminal set comprises through holes for fitting said plurality of terminals.

9. The structure of a connector according to claim 6, wherein said receiving portion of said terminal set comprises a plurality of positioning elements extending from a side thereof for inserting into corresponding indentations of said third circuit board for positioning.

10. The structure of a connector according to claim 6, wherein said receiving portion of said receiving module comprises two corresponding hook-shaped clamping portions, and said first circuit board comprises a through hole, said second circuit board comprises a buckling hole near a surface of said first circuit board, and wherein said clamping portions can fit through said through hole of said first circuit to buckle to said buckling hole for positioning.

* * * * *